US005533224A

United States Patent [19]

Knapp

[11] Patent Number: 5,533,224

[45] Date of Patent: Jul. 9, 1996

[54] FOAM PIG WITH SCRAPER STRIPS

[76] Inventor: Kenneth M. Knapp, 4018 W. Main, Houston, Tex. 77027

[21] Appl. No.: 421,058

[22] Filed: Apr. 12, 1995

[51] Int. Cl.[6] ..... B08B 9/04

[52] U.S. Cl. ..... 15/104.61

[58] Field of Search ..... 15/104.061, 3.5, 15/3.51

[56] References Cited

U.S. PATENT DOCUMENTS 3,204,274 9/1965 Knapp ..... 15/104.061
3,538,531 11/1970 Knapp et al. ..... 15/104.061
3,605,159 9/1971 Girard ..... 15/105.061
4,720,884 1/1988 Ralls ..... 15/104.61
4,825,498 5/1989 Rankin ..... 15/104.061

*Primary Examiner*—David Scherbel
*Assistant Examiner*—Tony G. Soohoo
*Attorney, Agent, or Firm*—Gunn & Associates

[57] ABSTRACT

A foam pig body supports one, two or three helical coil strips. Each strip is formed of a backing and supports plural ridges. The ridges extend radially outwardly to clean the pipeline. The ridges are at right angles to the centerline axis of the foam pig body.

17 Claims, 1 Drawing Sheet

FOAM PIG WITH SCRAPER STRIPS

BACKGROUND OF THE DISCLOSURE

The present disclosure is directed to a pipeline pig for use in cleaning the interior wall of a pipeline. In the present disclosure, a pipeline pig is set forth which incorporates an elongate cylindrical body having a bullet shaped nose at one end and having a transverse back wall at the opposite end. Between the two ends, there is an elongate cylindrical foam body. The foam body is made of a controllable weight of foam material. This provides a pig which has sufficient rigidity to ordinarily extend fully across the circular cross section of a pipe. Even though it is circular, the pig will deform when passing through elbows, valves, reducer nipples, and other changes in pipe size. Because of this construction, the pig is able to traverse any length of pipeline, and to also travel through all the obstructions that are encountered in typical pipeline construction for the express purpose of providing a pig body which deforms sufficiently that a seal is maintained as it travels.

The pig of the present disclosure is especially effective in wiping the pipeline on the interior surface. It forms a seal fully around the pig in contact with the pipeline to reduce leakage. The pig is provided with a transverse back end which is circular in shape and which has a finite thickness so that the circular back end of the pig is able to maintain an effective seal. Because this is provided, the pig is then able to travel with minimal leakage around the pig. Not only that, the pig is constructed with a set of strips on it, the strips including a plurality of scraper blades. The scraper blades are provided with a requisite amount of hardness so that the scraper blades drag on the sidewall and dislodge material from the sidewall. This is especially important in keeping a pipeline clear and free of sidewall coating materials. Consider a natural gas pipeline. In theory, it carries only gas in form, but as a practical matter, a number of gaseous components may liquefy or solidify. For instance, on a hot summer day, it not uncommon for the pipeline to carry a flow of natural gas with some water vapor in it, and certain molecules which will condense in regions of the pipeline where there is a significant temperature drop. On a hot summer day, such a pipeline flow may partially condense which will form in the pipe where the pipe passes under a river or other body of water. The river provides substantial cooling, and the cooling may readily create a large quantity of water condensation. This usually has the form of droplets which collect on the wall of the pipe. If the droplets are sufficiently numerous or large, they will trickle to the bottom of the pipe and will puddle along the bottom of the pipe. If the pipeline is built over valleys and hills, the puddle along the pipeline will trickle downhill and will ultimately collect in the valley of the pipeline, and can be in sufficient quantity that a water trap is accumulated in that region. Liquids formed by condensation are pushed through the pipeline and cleared from the pipeline by pigging the pipeline periodically.

Some of the liquids which condense in a pipeline are heavier molecules which means that they collect on the wall of the pipe and can form various thicknesses and hardnesses of a wall coating. In effect, a paraffin or wax accumulation is built. If that occurs, it sticks and become hardened as the lighter molecules evaporate out of the coating, thereby leaving a very heavy coating if not removed quickly. In summary, both water and oil base molecules can condense and create substantial problems after condensation if not removed periodically. The foregoing problem has been recognized in the past and pipeline pigs have been inserted into pipelines to enable pig removal of the deposits. Moreover, pipeline pigs with scraping surfaces or edges on them have been used in the past. There is a balance between the amount of scraping and the amount of sealing which is implemented to prevent or minimize leakage around the pig. Consider as an example a pipeline pig with a transverse scraper edge which is oversized and unduly stiff. The pig can either stall or wear away rapidly while the scraping edge is destroyed. There is a balance between the amount of stiffness, the amount of contact of the scraping edge with the wall of the pipe, and the amount of leakage by the scraping edges between the pipe and the pig.

The present disclosure sets forth an apparatus which can be installed in a pipeline for scraping and which is able to fully, completely, and controllably clear the pipeline. It is obtained by fabricating an elongate cylindrical pipeline pig which has a transverse back end with a planar face. The planar back face enables the pig to be used with a minimum of leakage by the pig. Such a pig will ordinarily suffice for cleaning a few miles of pipe. Pigs of this construction have been reinforced in the past by adding spiral strips of various abrasive materials. While they may suffer the bulk of the wear in traversing the pipeline, such spiral strips have sometimes been either too stiff or not stiff enough in light of the amount of scraping area provided by the spiral strips. The present applicant has provided such devices and they have worked quite well in the past. There are instances where the nature of the condensate in the pipeline changes so that a different measure of abrasion is desired. Strips have been provided in the past which have been equipped with wire bristles and tungsten carbide particles which scrape or scratch. In all such instances, while devices were successful, they do not necessarily find application for every pipeline pig cleaning operation. The present disclosure sets forth an improved pipeline pig constructed with between one and three spiral strips. While four can be included, the cost of fabrication is reduced by limiting the number typically to the range of one, two or three. One strip is less desirable than two or three strips because it is highly desirable that a every portion of the pipeline pig at any point around the circle of the pig body provide at least two scraping strips. Scraping edges are defined as those edges supported on the pig body and which provide scraping on the pipe. It is desirable that, at any point around the circumference, two strips present scraping edges. The scraping edges are deployed in strips which are set at an angle. By changing the helix angle of the strips mounted on the pig body, and by further changing the angle so that scraper edges on each strip are appropriately positioned with respect to the center line axis of the pig, it is possible to define a pipeline pig having multiple pipeline strips mounted thereon, thereby assuring that the strips provide a specified minimum of scraping edges. More specifically, the strips in the preferred embodiment are constructed with a scraping edge angled at 45° with regard to the strip. If the strip is then mounted at a 45° helix angel of the pig body, the scraping edges are deployed at right angles to the center line axis of the pig. If this is accomplished and there are multiple strips around so that the strips provide at least two strips at a given circumferential location, then the provision of the two strips assures adequate scraping by transversely positioned scraping edges.

Devises of this sort have been attempted heretofore. Two examples are found in the earlier Knapp U.S. Pat. No. 3,204,274 and also U.S. Pat. No. 3,389,417. These two issued patents involving the present inventor are appropriately noted. In addition, a more recent patent issued on Jan.

31, 1995 and is U.S. Pat. No. 5,384,929. These patents show various and sundry aspects of spiral strips. The spiral strips are useful and valuable in many aspects but the present disclosure sets forth improvements over the construction shown in those references. The disclosed construction has advantages which will be detailed hereinafter.

BRIEF SUMMARY OF THE DISCLOSED PIPELINE PIG

This disclosure sets forth a pipeline pig which is constructed with an elongate cylindrical foam core. The diameter equals that of the pipe and the length is a specified multiple of the pipeline diameter. Typically, the length is at least two times the diameter. Greater length is not usually needed. There is a transverse back face which is made of harder material and it serves to provide a circumferential seal to limit leakage past the pipeline pig. The pig is constructed with one, two, or three deployed strips having a helical mounting angle which positions certain angled scraping edges for contact against the pipe. In the preferred embodiment, there are two or three such helical strips. Each strip in turn is constructed with protruding scraping edges which are set at an angle on the strips. By mounting the strips at a 45° angle and by positioning scraper edges on each strip at 45°, a set of scraping edges can be positioned where each scraping edge is transverse to the center line axis of the pipeline pig, and each strip in turn is provided with any number of such edges, the edges preferably being spaced evenly along the strips. This also causes the pipeline pig to rotate as it travels through a pipeline. Rotation distributes wear fully around the pig and avoids the formation of a flat side or face.

DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
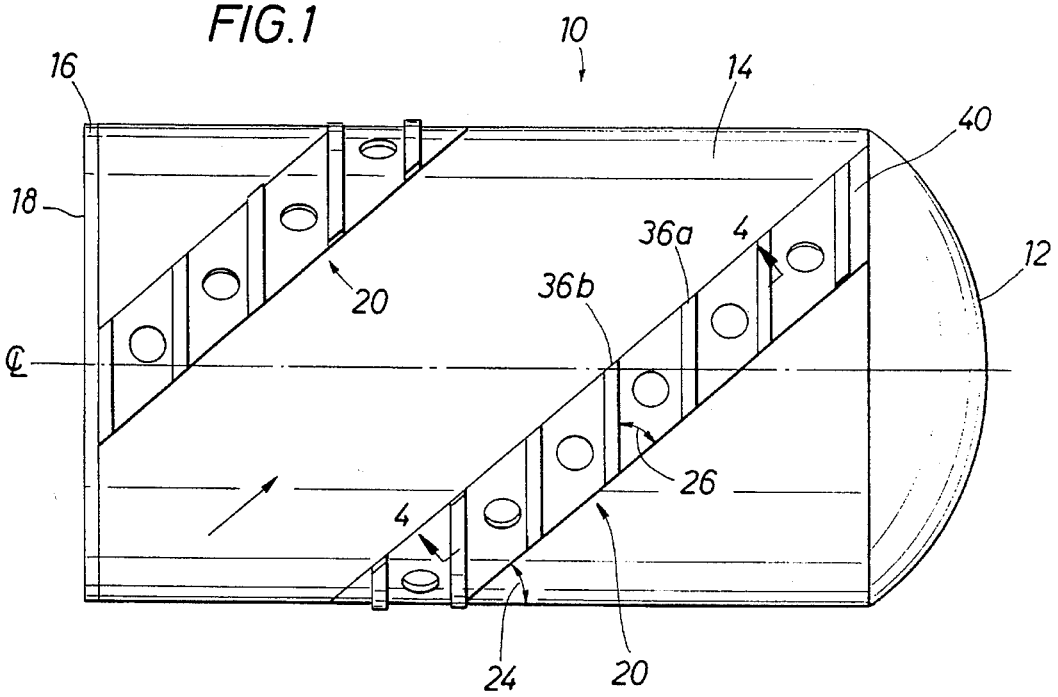
FIG. 1 is a side view of a pipeline pig constructed in accordance with the present disclosure showing multiple strips mounted at a helical angle wherein each strip supports separate, spaced, scraping edges deployed at right angles with respect to the center line axis of the pipeline pig.

Attention is now directed to FIG. 1 of the drawings where the numeral 10 identifies the pipeline pig of the present Disclosure. An example will be cited regarding this pipeline pig. Assume for purposes of description that it is a 16 inch pig to be used in a pipeline of 16" nominal ID. The pig is constructed with a bullet shaped nose 12 at the forward or leading end. It has a body 14 which is constructed of open or closed cell foam which has a specified density. The foam body 14 is elongate and cylindrical. The foam body 14 has a density which is anywhere between about 3 to about 12 pounds per cubic foot. When made lighter, the foam body may lack structural strength and-integrity to last very long during use. While it will be relatively flexible and pliable, it will not have sufficient strength to undergo of rigors of cleaning the pipeline. If made heavier, it may attain sufficient structural strength and integrity for long pigging trips but it may become sufficiently expensive and costly that it will not be desirable to use such a pig. There is therefore a balance in the amount of foam material which is incorporated in the pig body and a preferred range is given above, and it is believed that an optimal density is somewhere in the range of about 6 to 9 pounds per cubic foot. For use in a 16" pipeline, the pig body has a nominal diameter of 16" which is approximately the same as the ID in the pipeline, and it is constructed of either open or closed cell foam construction. The length is approximately two times the diameter or even greater. As the length increased, the foam involved in the pig construction becomes more costly. It is therefore desirable to generally obtain a length which is about two times the diameter.

The pig is constructed with a back stiff member 16 having a back face 18. This is integrally cast at the time of fabrication of the pig. This back disk defines the rearward face of the pig. It incorporates an outer cylindrical edge or surface 22 in contact with the pipe. This maintains the pipe in contact with the pig at all points around the body of the pig. This also assures that the pipeline pig will travel the length of the pipe with a minimum of leakage around the pig. This can be formed of harder material. Preferably, it has a thickness of ⅛" up to about ½" depending on pipeline diameter. Harder material can be obtained by using a heavier weight of polyurethane or other polymeric materials. The polymeric materials are chosen to provide the requisite hardness. As mentioned, the foam body 14 is relatively soft. The backface can have a hardness of anywhere from about 20 to about 90 durometer. Since the thickness is only a fraction of an inch, it is desirable that the back face typically have support with the pig body, and this is obtained by fabricating the back face on the from the pig body. The body and face are bonded together in manufacturing.

As described to this point, a pig comprising solely the foam body 14 and the transverse back face 18 will clean pipes and will dislodge some portion of the coating material on the wall and will push condensed liquids along the pipeline. To enhance that construction, strips are placed in a spiral fashion around the pipeline pig.

In the preferred embodiment, there are one, two, or three strips. One strip is acceptable provided it has a sufficient length so that it encompasses the pig body at least by one full revolution. Ideally, two full revolutions will suffice. In that instance, the one strip will then contact every point around the circle with scraping edges at least at two locations. This typically requires construction of a longer pig and increases the weight of the pig and the cost of the pig. To obtain a shorter pig, two strips are preferred. In that instance, each strip is required to encircle the pig by one full revolution. Better yet, if three strips, each strip preferably then has a minimum of two thirds of a revolution. Perhaps this will be more clear on a description of the scraper edges which are supported by each strip.

FIG. 1 shows two such strips indicated by the numeral 20 and mounted on the pig body. The strips extend in a common direction so that the strips impart a spiraling motion to the pig. As the pig travels through the pipeline by any distance, the helical mounting of the strips causes rotation. Rotation distributes the wear around the entire surface so that a flat side is not formed.

Figure 2:
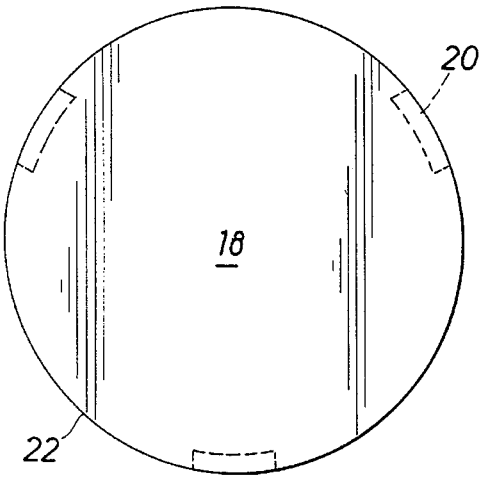
FIG. 2 of the drawings is an end view of the pipeline pig shown in FIG. 1 of the drawings and showing how the strips on the exterior are recessed.
Figure 3:
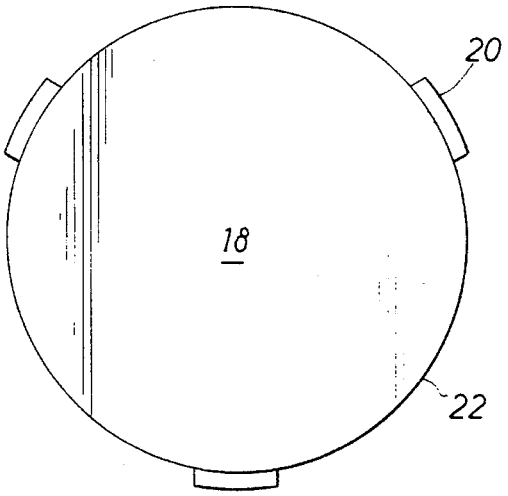
FIG. 3 of the drawings is view similar to FIG. 2 showing where the strips extending outwardly to a diameter greater than the pig diameter.

From FIG. 2 of the drawings, it will there be observed that there are three strips 20, around the pig body. The back face 18 is shown to be a circle and includes the peripheral edge 22 which normally forms the seal to limit leakage. It will be observed that each strip 20 is recessed within the circle 22. In addition to that, it will be observed that the strips 20 are recessed in the body so that they do not extend beyond the circle 22. This is accomplished by placing the strips 20 in recessed channels having the necessary width and depth to receive the strips so that they are mounted to a common height with respect to the circle 22. In the embodiment shown in FIG. 2 of the drawings, the strips do not extend taller than the circle 22. By contrast, an alternate form is shown in FIG. 3 of the drawings. FIG. 3 shows a relatively small protrusion of the strips 20. This defines the height of the strips with respect to the circle 22. For pigs which are less than about eight inches in diameter, this height is less than about ⅛". For pigs which range from about 8" to 16", this height is approximately ⅛" as an optimum. For pigs larger than 16", this height is approximately 3/32" or less. There is no significant gain by making the strips much taller than the given dimensions. If taller, leakage around the circle 22 is increased. Wear on the strip edges occurs more rapidly. The abrasive or scraping action is not much better. For those reasons, a limited amount of height is desirable, but an excess of height is undesirable.

Figure 4:
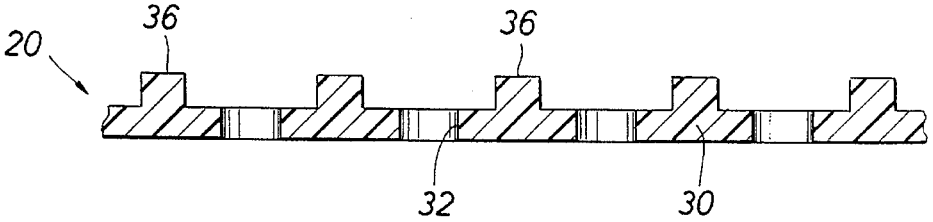
FIG. 4 is a sectional view along the line 4—4 of FIG. 1 showing details of construction of an individual strip.

Attention is now directed to FIG. 4 of the drawings where an individual strip as shown in detail. The individual strip can be provided by a fabricator with a specified length, width and a specified set of edges. The strip 20 in FIG. 4 is preferably installed at a desired helical angle, one embodiment being a 45° angle. By using that angle, some benefit can be obtained. The strip, installed at a 45° angle in the finished product, supports a set of transverse sloping edges which are at a 45° angle. By adding the two angles together, a construction is obtained in which the strips position scraping edges at right angles with respect to the center line axis of the pipeline pig 10. In this particular embodiment, the 45° angle for the strip and the 45° angle of the edges on the strip locate edges at a 90° angle with respect to the axis. If the strips are deployed at a 30° angle on the strip material, then the edges are deployed at right angles if the helical angle is 60°. As will be understood, two angles determine the angular position of the scraping edges. One angle is the angle identified at 24 of the drawings while a second angle is shown at 26 of the drawings. By appropriate manipulation of the angles 24 and 26, the end result is construction of a set of scraping edges at right angles to the center line axis. The angle 24 will be defined hereinafter as the helical angle. It is the angle at which the strips are mounted. The angle 26 will be defined as the scraper angle. It is the angle at which the scraping edges are deployed. As will be understood, if the angle 24 is 60°, the angle 26 need only be 30° to position the edges at right angles. If the 24 were only 30°, then the angle 26 must be 60° to provide the same result.

Attention is now directed to FIG. 4 of the drawing which shows an individual piece of strip material. It is constructed with a backing portion 30. The strip is drilled periodically with small perforations 32. These assist in bonding at the time of fabrication. The perforations 32 are partly filled with a liquid bond agent to attach the strip to the pig. In one aspect, the strip is preferably adhesively joined by use of the bonding material. It fills the perforations 32 and extends up through them and up over the top of the strip backing. This enhances the contact.

The strip is constructed with a sort of spaced ridges which become scraper edges and which are identified at 36. They all have equal height and equal width. While they can be made to different thicknesses, it is preferable that they extend by an equal height so that the several ridges 36 define a cylindrical surface about the entire length of the pig. The ridges 36 are constructed so that they have a length which is perpendicular to the deployment shown in FIG. 4. The ridges can have any specified length such as 1 to 4 inches. Longer ridges can be used but it is more desirable to decrease the length and utilize an increased number of strips. The number of strips, is represented by the symbol N where N is preferably 1, 2, or 3 in most embodiments. In very large sizes, the number of strips can be increased, but that is a rare occurrence. Each strip has a width that is in the range of about 2 to about 4 inches. If the strip is made much wider than that, it is then generally limited to use on a relatively large diameter pipeline pig.

The ridges 36 have a common height and common thickness. They also have common lengths. The spacing from ridge to ridge is sufficient to enable the perforation 32 to be formed either by drilling or cutting. The perforation enhances the contact area or the grip to hold the strips in place. The strips are likewise constructed of a single material. In casting the strips, the material is a pliable plastic such as polyurethane, or some copolymer system, and has a hardness anywhere between about 20 and 90 durometer. In that sense, the strips are pliable and can be deformed by hand. This defines the ridges 36 so that they are able to bend, fold, or otherwise deflect. Strips are constructed with this arrangement. The strips 36 thus enable a cleaning action as will be described.

Going now to FIG. 1 of the drawings, it will be observed that there is a first ridge **36*a* shown in FIG. 1 and it overlaps with a second strip, 36*b*, which is spaced from the first ridge 36*a*. The ridges 36*a* and 36*b* provide scraping action. In addition to those ridges, scraping action is also furnished by ridges on the remaining strips attached to the pipeline pig. The action of these strips imparts rotational or processional movement to the pig in the direction of the arrow marked in FIG. 1**. Since the pig is urged from left to right by pipeline fluid flow, such movement to the right provides scraping action with the several ridges. The many ridges dislodge the materials on the sidewall of the pipe, and keep the pipeline cleared and clean.

Strips 20 are attached to the pig body with a suitable adhesive. They are preferably placed at the right angle on the exterior of the foam pig body 14 and a coating material is placed on the pig body. A heavier weight of polyurethane can be used. While the body 14 may be formed by foamed polyethylene or polyurethane, its preferable to use a heavier weight bond to attach the strips adequately. The forward most end of each strip is represented in FIG. 1 of the drawings by the numeral 40. That end of the strips bends over the curvature at the nose. This assures that the forward end of the strip does not drag on the wall of the surrounding pipe. This enables the forward end to extend around the corner, so to speak, thereby assuring that the strip end will not come loose or become detached. This is done preferably on all three of the strips on the preferred embodiment illustrated in FIG. 1. At the back end, the strip is recessed in the foam body as it is along the length in accordance with the construction of the FIG. 2 of the drawings. This enables the strip to be mounted so that the top face of the ridge 36 shown in side view in FIG. 4 of the drawings is arranged even or on a line with the circle 22 at the back face. The scope is determined by the claims which follow.

I claim:

1. A pipeline pig for cleaning the interior of a pipe comprising: a cylindrical pig body formed of a plastic foam having a specified density wherein the pig body incorporates a forward end and the opposite end thereof includes a back face of circular shape so that the pig is able to travel through a pipeline urged by fluid flow in the pipeline; at least one helical spiraled strip positioned about said cylindrical pig body to extend along the length thereof wherein the strip is an elongate flexible backing adhesively joined to said pig body and said backing is constructed with two edges to enable bonding to said pig body, and said strip backing is perforated to enhance bonding to said pig body and said strip incorporates a plurality of protruding ridges thereon and said ridges have exposed outer faces where said exposed outer faces are contacted against the inside wall of the pipe when the pig is moved along the pipeline and said ridges are constructed in sufficient number and spacing so that scraping occurs by said ridges and said ridges collectively remove deposits, condensation and other materials collecting on the wall of the pipe at the interior.

2. The apparatus of Claim 1 wherein said back face is harder than said pig body and has a thickness between about ⅛" and ½" and is bonded to said pig body.

3. The apparatus of Claim 2 wherein said strip is recessed into said pig body and the top of said strip is comprised of said ridges.

4. The apparatus of Claim 3 wherein pig body supports N strips where N is 1, 2 or 3 and said strips have a common helical angle.

5. The apparatus of Claim 2 wherein said strip forms at least two strip portions at any location around the periphery of said pig body.

6. The apparatus of Claim 5 wherein said strip is 2 or 3 strips.

7. The apparatus of Claim 1 wherein said pig body supports 2 or 3 of said strips and said strips are positioned at a common helical angle with respect to said pig body.

8. The apparatus of Claim 7 wherein said pig body is formed having a density in the range of about 3 to about 12 pounds per cubic foot.

9. The apparatus of Claim 8 wherein said pig body is formed having a density in the range of about 6 to about 9 pounds per cubic foot.

10. The apparatus of Claim 1 wherein said strip supports said ridges radially of said pig body at a height equal to the periphery of said back face.

11. The apparatus of Claim 10 wherein said strip is defined by a unitary strip backing and integral ridges formed thereon, and said ridges are equal in ridge height, width, thickness and spacing along said strip backing.

12. The apparatus of Claim 1 wherein said strip is adhesively bonded to said foam body; and said foam body has a tapered nose portion at one end thereof, and said strip extends onto said tapered nose portion so that said strip on said nose portion is not in contact with said pipe.

13. The apparatus of Claim 1 wherein said strip is positioned at a helical angle, and said ridges on said strip define a selected second angle, and said helical and selected second angles are so related that said ridges are at right angles to said pig body.

14. The apparatus of Claim 13 wherein said helical angle is less than 90°.

15. The apparatus of Claim 13 wherein said pig body supports two strips and said strips each extend one complete revolution around said pig body.

16. The apparatus of Claim 1 wherein:

(a) said pig body is formed polyurethane of less than about 13 pounds per cubic foot;

(b) said strip is cut from an elongate backing having said ridges thereon; and (c) said ridges include a rectangular face for contact with said pipe.

17. The apparatus of Claim 16 wherein said ridges and said strip backing are integral, and said backing is adhesively attached to said pig body.

* * * * *